United States Patent [19]

Simmons

[11] Patent Number: 4,676,443

[45] Date of Patent: Jun. 30, 1987

[54] YARN DISPENSING DEVICE

[76] Inventor: Mark H. Simmons, 118 Bay Dr., North, Indian Harbour Beach, Fla. 32937

[21] Appl. No.: 744,756

[22] Filed: Jun. 14, 1985

[51] Int. Cl.[4] ..... B65H 20/02; B65H 49/02; B65H 59/12; D04B 15/50

[52] U.S. Cl. ..... 242/54 R; 66/132 R; 66/163; 226/43; 226/181; 242/1

[58] Field of Search ..... 223/107; 66/163, 132 R, 66/1 A; 242/127.1, 129, 172, 54 R; 226/127, 138, 161, 43, 168, 42, 176, 196, 181, 182, 24, 37

[56] References Cited

U.S. PATENT DOCUMENTS

| | | | |
|---|---|---|---|
| 1,986,121 | 1/1935 | Sargent | 226/196 X |
| 3,309,752 | 3/1967 | Nuissl | 226/181 X |
| 3,355,868 | 12/1967 | Civrny et al. | 226/181 X |
| 3,782,661 | 1/1974 | Deniega et al. | 66/132 R X |
| 3,974,949 | 8/1976 | Peterson | 226/42 |
| 4,327,873 | 5/1982 | Juppet et al. | 226/24 X |

*Primary Examiner*—Stuart S. Levy
*Assistant Examiner*—Lynn M. Sohacki

[57] ABSTRACT

The present invention relates to a dispensing device for yarn which includes a loose skein holding section and a pair of feed rolls having a bite therebetween to move yarn from the skein holding section to a discharge side. A yarn gathering guide is positioned between the skein holding section and the feed rolls and a loop separating chamber is located between the skein holding section and the gathering guide. The feed rolls are responsive to a switch which is activated by tension on the yarn on the discharge side.

10 Claims, 5 Drawing Figures

YARN DISPENSING DEVICE

TECHNICAL FIELD

The present invention relates to dispensing means for yarn and the like; and more particularly to means for delivering yarn from skeins as required by a hand knitting operation.

BACKGROUND OF THE INVENTION

Hand knitters require yarn free of knots at infrequent intervals, and at no, or substantially no, tension.

Accordingly, it is an object of the present invention to provide means for dispensing yarn, string, or the like in a manner which provides it knot free, and without interferring drag on the hands of hand knitters, crocheters, etc.

A further object of the present invention is to provide dispensing means of the above described type which will hold a loose skein of yarn and unravel it in a manner permitting ready access to all parts of the skein holding and dispensing means.

A further object of the present invention is the provision of dispensing means of the above described type which is easily threaded, and which will prevent the yarn from breaking should a knot develop in the skein unraveling operation.

Further objects and advantages of the present invention will become apparent to those skilled in the art to which the invention relates from the following description of the preferred embodiment described with reference to the accompanying drawings forming a part of this specification.

DESCRIPTION OF THE PREFERRED EMBODIMENT

Figure 1:
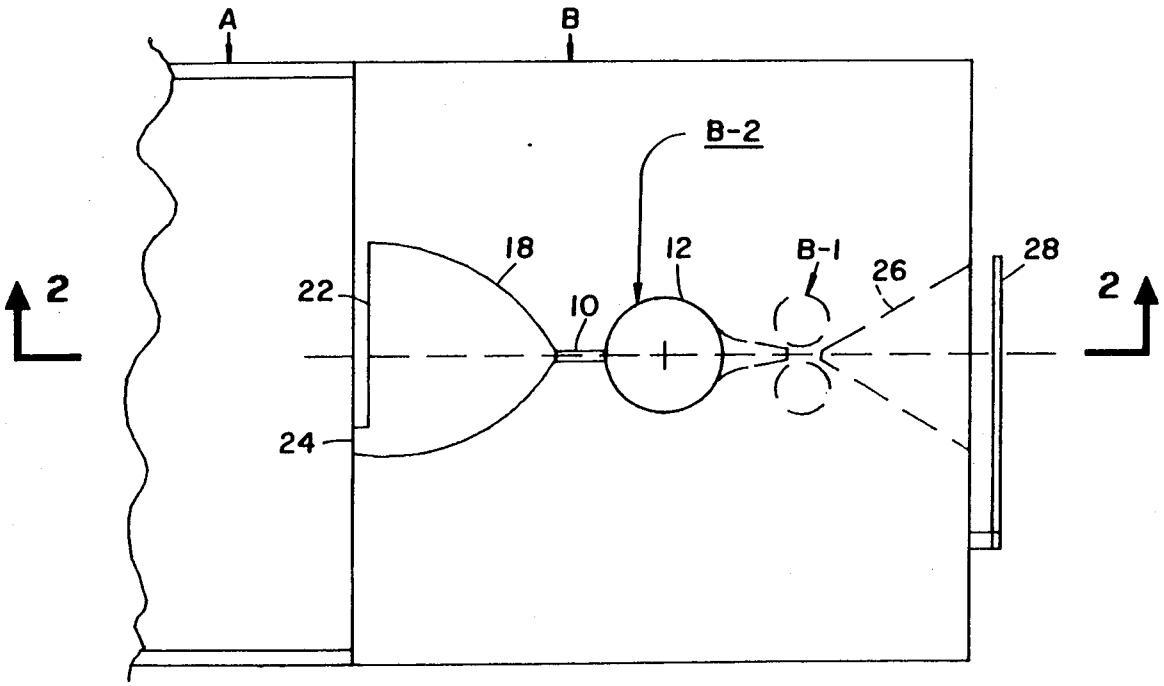
FIG. 1 is a plan view of a yarn dispensing means embodying principles of the present invention.
Figure 2:
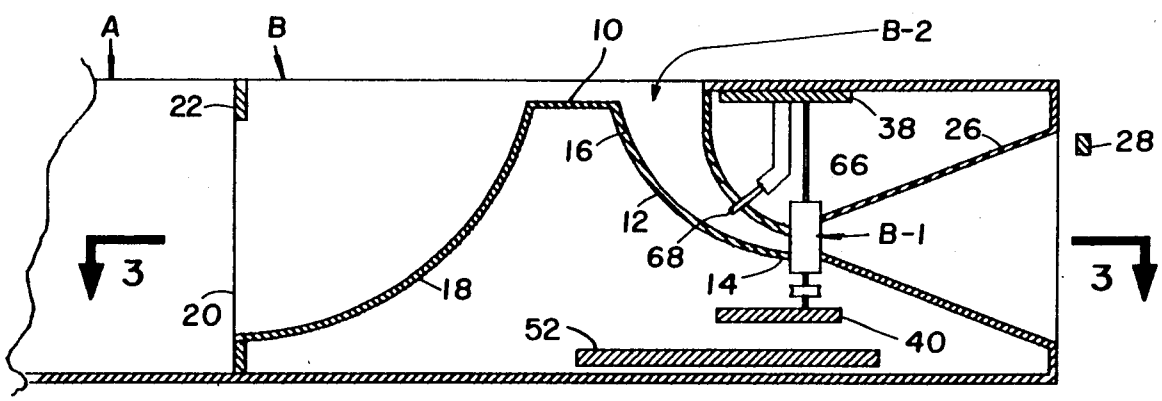
FIG. 2 is a cross sectional view taken approximately on the line 2—2 of FIG. 1.
Figure 3:
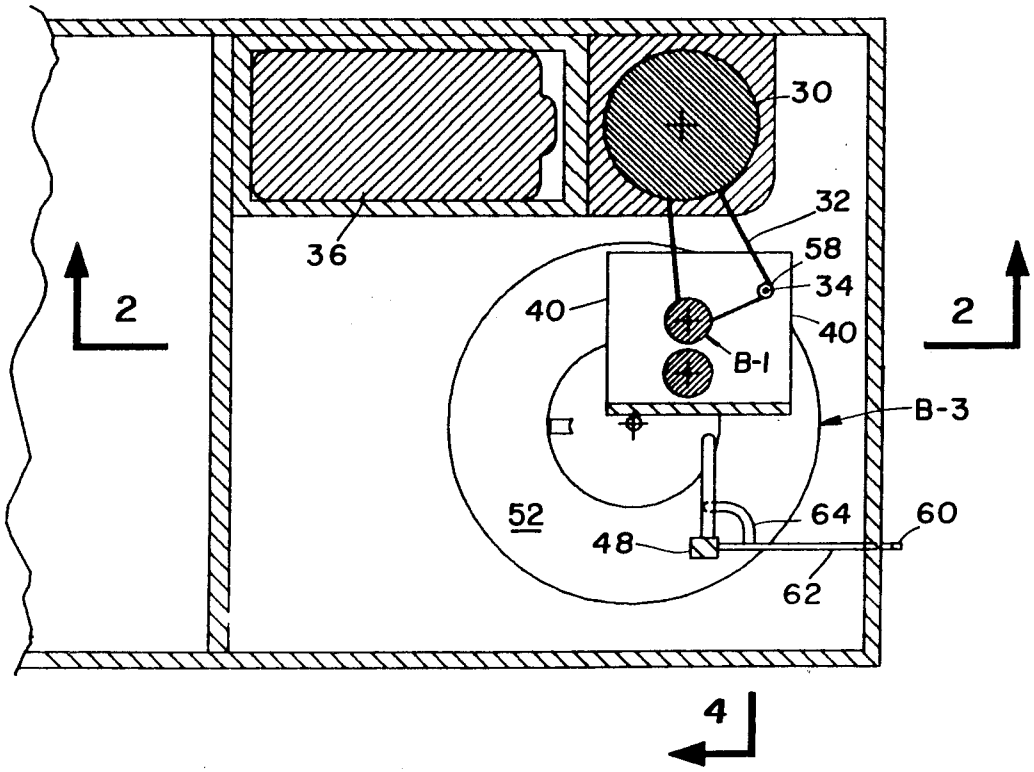
FIG. 3 is a cross sectional view taken approximately on the line 3—3 of FIG. 2.
Figure 4:
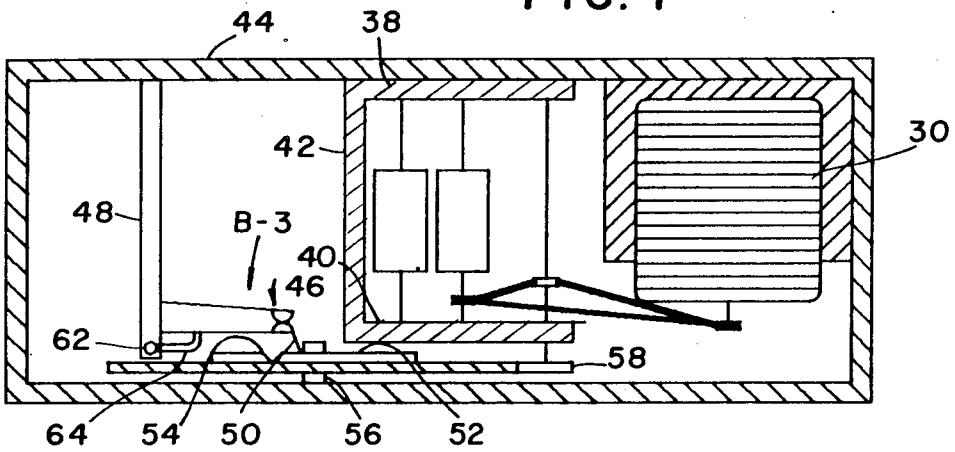
FIG. 4 is a fragmentary sectional view taken approximately on the line 4—4 of FIG. 3.

The embodiment shown in the drawings generally comprises a rectangular box-like structure having a skein holding section A, and an unraveling and dispensing section B. The section A is a generally open top rectangular box in which a skein is placed lengthwise with one end adjacent the dispensing section B. The skein is preferrably unraveled by pulling the yarn end that is located at the center of the skein, endwise out of the skein. With this procedure, the outside of the skein generally holds its shape until the center is depleted. The unraveling and dispensing section B generally comprises a pair of feed rolls B-1, an unraveling and guide section B-2 (see FIGS. 1 & 2), and a control section B-3 (best seen in FIGS. 3 & 4).

The unraveling and guide section B-2 has a yarn gathering guide 10 that is preferably open topped and located at an elevation above the feed rolls B-1. The gathering guide 10 feeds into an intermediate guide section 12 that takes the yarn down to the bite of the feed rolls B-1. In the embodiment shown, the intermediate guide section 12 is powder horn-shaped with its narrow end 14 positioned immediately adjacent the bite of the feed rolls B-1, and with the gathering guide feeding into the side of the hornshaped intermediate guide 12 adjacent its large diameter open end 16. Between the skein holding section A and the gathering guide 10 is a loop separating chamber 18 that preferably has the shape of a funnel having outwardly bulging sides. The large end 20 of the funnel is positioned adjacent the skein holding section A, and the small end of the funnel feeds into the gathering guide 10. Because the funnel is located at the top of the box above the elevation of the center of a skein in the skein holding section A, the loop separating chamber 18 needs only comprise one half of the above described funnel, and can open outwardly of the cover of the device. A finger 22 extends most of the way across the large diameter end 20 of the funnel to act as an abutment for the end of a skein in the skein holding section A. The bowed or barrel shaped sides of the loop separating chamber 18 form a chamber which will accommodate several coils of the skein should they be pulled out of the skein together. The coils will sink and rest on the bottom bowed walls of the loop separating chamber 18 while the gathering guide 10 will cause the yarn to be pulled upwardly from the coils resting on the bottom of the loop separating chamber 18. The space 24 between the end of the finger 22 and the side of the loop separating chamber allows the yarn to be threaded easily through the loop separating 18, the gathering guide 10, and the intermediate guide section 12. By pushing the end of the yarn down into the powder hornshaped intermediate guide section 12, the end of the yarn is automatically fed into the bite of the feed rolls B-1. A diverging discharge funnel 26 extends from the rolls B-1 to the discharge end of the device to guide the end of the yarn out of the device.

According to further principles of the present invention, the rolls B-1 are caused to revolve a generally predetermined number of revolutions and then stop each time the operator desires yarn. In the embodiment shown, this function is initiated by a yarn contacting finger 28 that extends across the end of the discharge funnel 26. The yarn discharged by the rolls B-1 passes beneath the finger 28 and will lie on the surface on which the device rests. Th1s usually will be the floor at the feet of the operator. As the operacor uses the yarn that rests on the floor, the yarn will be pulled upwardly by the hands of the operator since the rolls are now stationary. Upward movement of the hands of the operator in normal knitting fashion will raise the yarn contacting finger 28 and cause the rolls B-1 to be actuated.

The rolls B-1 are driven by an electric motor 30 and rubber drive belt 32. An adjustable drive shaft 34 permits proper tension to be applied to the belt 32. The motor 30 may be powered by any suitable source, and in the embodiment shown is powered by a dry cell battery 36. The rolls B-1 and shaft 34 are suitably journaled between the top and bottom legs 38 and 40 of a channel shaped bracket 42 that is supported by the top or cover 44 of the device.

The motor 30 is stopped and started by a pair of electrical contacts 46 that are supported by a bracket 48 from the top 44 of the device. The contacts 46 are normally open or spaced apart, and the bottom contact 46 has a leg 50 which rests on the top surface of a horizontal disc 52. The disc 52 has a groove 54 in its top surface into which the leg 50 can enter to open the contacts 46. When the leg 50 is sliding on the top of the disc 52, however, the contacts 46 are closed. The disc 52 is journaled on a vertical shaft 56 that is supported from the bottom of the box; and the disc is rotated by a rubber wheel 58 that abuts the side edge of the disc 52. The wheel 58 is carried by the lower end of the drive shaft 34 which is suitably journaled by means not shown, so that the wheel 58 can be clamped against the disc 52 in a position to tighten the drive belt 32.

The yarn contacting finger 28 has a depending leg 60 that is carried by a horizontal shaft 62 that is located just above the disc 52. The shaft 62 is journaled by the side of the box and the lower end of bracket 48 beneath the contacts 46. The shaft 62 has an arm 64 which abuts the bottom contact 46 in a position to raise the bottom contact up against the top contact 46 when the yarn contacting finger 28 is raised by the operator. Abutment of the contacts causes the motor 30 to be actuated and revolve the disc 52, so that the leg 50 of the bottom contact slides on the top surface of the disc to hold the contacts together. After one turn of the disc 52, the leg 50 falls down into the groove 54 to open the contacts and stop the motor.

While not necessary in all instances, the device will preferably include a stop switch 66 for stopping the motor should a snag in the yarn occur ahead of the rolls. In the embodiment shown, a stop guide 68 extends across the horn-shaped intermediate guide 12. The stop guide 68 extends through the side walls of the horn 12 below the imaginary line connecting the gathering guide 10 and the discharge of the horn 12. The stop guide 68 is raised when the yarn becomes taunt, and the stop guide 68 then opens the stop switch 66. The switch 66 is suitably supported from the bracket 42, and the stop guide 68 is its actuating lever.

Figure 5:
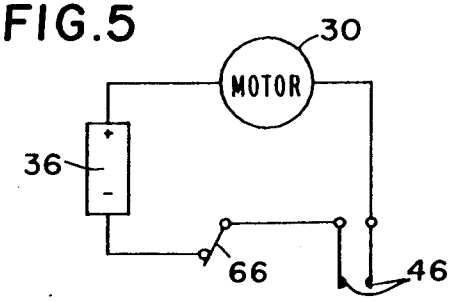
FIG. 5 is a schematic wiring diagram for the device.

FIG. 5 is a schematic wiring diagram for the device, and its operation will be readily understood by those skilled in the art after reading the above description of the device and its operation.

In operation, a skein of yarn is placed in the skein holding section A, and the end of yarn from the center of the skein is put through the space 24 and under finger 22. The yarn end is pulled out of loop separating chamber 18 and is then fed down the open end 16 of the intermediate guide section 12, and under the stop guide 68 until it reaches the feed rolls B-1. The yarn is pushed down into the gathering guide 10 and the finger 28 is lifted to start the electric motor 30. Contact of the yarn end with the revolving feed rolls causes the rolls to feed the yarn into the discharge funnel 26 and out under the yarn contacting finger 28. When sufficient yarn is discharged to allow its knitting by the user, the finger 28 is released; and during the next rotation of the horizontal disc 52, the leg 50 drops into the groove 54 and the contacts 46 open. Thereafter, when the slack in the yarn between the users hands and the feed rolls B-1 is used up, the finger 28 is lifted by the yarn, leg 50 comes out of the groove 54, and the motor 30 is started. Thereafter, leg 50 rides on top of the horizontal disc 52 to deliver a predetermined amount of loose yarn onto the floor at the feet of the user. When groove 54 returns beneath leg 50, it drops down into the groove to automatically stop the motor.

Should one or more loops of yarn be pulled from the skein to cause a snag, the snag eventually reaches the gathering guide 10. If unattended to, tension produced by the feed rolls causes the yarn to be pulled upwardly against the stop guide 68 to stop the motor. Since the loop separating chamber 18 has an open top, the snag is readily seen by the operator who can then uncoil the snag in the space provided by the loop separating chamber 18. In some instances, the gathering guide 10 will uncoil the snag, and the loose yarn will fall downwardly by its own weight into the space provided by the curved bottom of the loop separating chamber. Those skilled in the art, will readily understand the operation of the electrical circuitry, and the details of the drive mechanism.

While the invention has been described in considerable detail, I do not wish to be limited to the particular embodiment shown and described; and it is my intention to cover hereby all novel adaptations, modifications, and arrangements thereof which come within the practice of those skilled in the art to which the invention relates, and which fall within the purview of the following claims.

I claim:

1. Dispensing means for yarn and the like, comprising: loose skein holding means a loop separting chamber, a pair of feed rolls having a bite therebetween to move yarn from said skein holding means to a discharge side; a movable yarn contacting finger at the discharge side of said feed rolls; means which when said yarn contacting finger is moved causes said feed rolls to rotate to generally predetermined number of revolutions and then stop.

2. The dispensing means of claim 1 including: a yarn gathering guide positioned between said skein holding means and said feed rolls; and a said loop separating chamber positioned between said skein holding means and said gathering guide with the bottom of said separating chamber being at an elevation well below that of said gathering guide.

3. The dispensing means of claim 2 wherein said gathering guide is at an elevation above said bite of said rolls, and said dispensing means includes an intermediate guide for receiving yarn from said gathering guide and feeding it to said bite of said rolls.

4. The dispensing means of claim 3 wherein: said intermediate guide is generally powder horn-shaped with its narrow end feeding into said bite of said rolls, and with said gathering guide feeding into the large end of said generally powder horn-shaped intermediate guide.

5. The dispensing means of claim 4 wherein: said yarn gathering guide, loop separating chamber, and large end of said generally powder horn-shaped intermediate guide all open outwardly of the top surface of said yarn dispensing means for easy access and threading of the yarn through said dispensing means.

6. Dispensing means for yarn and the like comprising: loose skein holding means; a pair of feed rolls having a bite therebetween to move yarn from said skein holding means to a discharge side; a yarn gathering guide positioned between said skein holding means and said feed rolls; and a loop separating chamber positioned between said skein holding means and said gathering guide with the bottom of said separating chamber being at an elevation well below that of said gathering guide.

7. The dispensing means of claim 6 wherein; said gathering guide is at an elevation above said bite of said rolls and said dispensing means includes an intermediate guide for receiving yarn from said gathering guide and feeding it to said bite of said rolls.

8. The dispensing means of claim 7 including: a stop guide positioned to one side of the imaginary line connecting said gathering guide and said bite of said rolls;

and means for stopping said rolls when yarn on said one side of said imaginary line is pulled taunt against said stop guide.

9. The dispensing means of claim 8 wherein: said intermediate guide is generally powder horn-shaped with its narrow end feeding into said bite of said rolls and with said gathering guide feeding into the large end of said generally powder horn-shaped intermediate guide.

10. The dispensing means of claim 9 wherein: said yarn gathering guide, loop separating chamber, and large end of said generally powder horn-shaped intermediate guide all open outwardly of the top surface of said yarn dispensing means for easy access and threading of the yarn through said dispensing means.

* * * * *